US008752831B2

(12) United States Patent
Zirilli et al.

(10) Patent No.: US 8,752,831 B2
(45) Date of Patent: Jun. 17, 2014

(54) SYSTEMS AND METHODS FOR CONTROLLING SUBSTRATE FLATNESS IN PRINTING DEVICES USING THE FLOW OF AIR

(75) Inventors: Francisco Zirilli, Penfield, NY (US); Susan Aurand, Fairport, NY (US); Richard A. Van Dongen, Newark, NY (US); Chad Labarge, Fairport, NY (US); Ivan Delgado-Velazquez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 391 days.

(21) Appl. No.: 12/246,183

(22) Filed: Oct. 6, 2008

(65) Prior Publication Data

US 2010/0084809 A1 Apr. 8, 2010

(51) Int. Cl.
*B65H 5/00* (2006.01)

(52) U.S. Cl.
USPC ..... 271/264; 271/194

(58) Field of Classification Search
USPC ..... 271/264, 194, 278, 306
See application file for complete search history.

(56) References Cited

U.S. PATENT DOCUMENTS 3,028,502 A 4/1962 Schiffbauer et al.
3,174,748 A 3/1965 Roberts et al.
3,278,754 A 10/1966 Wallace
3,595,563 A 7/1971 Rostoker et al.
3,804,401 A 4/1974 Stange
4,277,177 A * 7/1981 Larsen et al. ..... 356/431
4,552,448 A 11/1985 Davidson
4,685,139 A 8/1987 Masuda et al.
4,997,178 A 3/1991 Ogoda
5,125,037 A 6/1992 Lehtonen et al.
5,144,566 A 9/1992 Anderson et al.
5,183,251 A 2/1993 Sardella
5,344,133 A * 9/1994 Jantsch et al. ..... 271/94
5,467,180 A 11/1995 Malachowski et al.
5,526,028 A 6/1996 Rottman
5,537,615 A 7/1996 Kelly
5,642,189 A 6/1997 Alguard
5,732,632 A 3/1998 Oomoto et al.
5,774,635 A 6/1998 Kuusisto et al.
6,175,700 B1 1/2001 Miller et al.
6,192,140 B1 2/2001 Reinhard et al.
6,223,585 B1 5/2001 Krogstad
6,621,576 B2 9/2003 Tandon et al.
6,845,288 B2 1/2005 Pierel et al.

(Continued)

FOREIGN PATENT DOCUMENTS

JP 60-40372 A 3/1985
JP 1-092150 A 4/1989

*Primary Examiner* — Ernesto Suarez
(74) *Attorney, Agent, or Firm* — Pillsbury Winthrop Shaw Pittman, LLP

(57) ABSTRACT

Systems and methods are provided for controlling substrate flatness for sensor measurements in printing device. A flow of air may be provided from a blower to a plenum. A printed sheet of media may be transported between upper and lower transport baffles that are generally spaced apart to permit the sheet of media to pass. Located on one of transport baffles may be a sensor to measure a property of the printed sheet. Air from the plenum is provided to the back surface of the sheet to urge it toward the sensor.

24 Claims, 13 Drawing Sheets

(56) References Cited

U.S. PATENT DOCUMENTS

| | | | | |
|---|---|---|---|---|
| 6,961,526 | B2 | 11/2005 | Tezuka et al. | |
| 6,975,949 | B2 | 12/2005 | Mestha et al. | |
| 7,631,863 | B2 | 12/2009 | Förch et al. | |
| 7,659,984 | B2 | 2/2010 | Schaede | |
| 2003/0094751 | A1 | 5/2003 | Takei | |
| 2004/0075213 | A1* | 4/2004 | Obama et al. | 271/258.01 |
| 2006/0114313 | A1* | 6/2006 | Moore | 347/262 |
| 2006/0221362 | A1* | 10/2006 | Julien | 358/1.4 |
| 2007/0216087 | A1 | 9/2007 | Matsudaira et al. | |
| 2010/0084804 | A1 | 4/2010 | Zirilli | |
| 2010/0123780 | A1 | 5/2010 | Wiebe | |
| 2010/0201061 | A1 | 8/2010 | Zirilli et al. | |

* cited by examiner

SYSTEMS AND METHODS FOR CONTROLLING SUBSTRATE FLATNESS IN PRINTING DEVICES USING THE FLOW OF AIR

FIELD

This application generally relates to systems and methods for controlling substrate flatness in printing device, in particular, using the flow of air.

BACKGROUND

In order to make color spectral measurements in printing device, a sheet of paper (or other substrate media) may be transported past an embedded or inline spectrophotometer or other measurement device for monitoring printed images. If the sheet of paper is not sufficiently "flat" as it passes the spectrophotometer, especially while traveling at high speeds (e.g., up to 3 m/s), accurate color spectral measurements may be comprised and/or unobtainable.

SUMMARY OF APPLICATION

According to one aspect of the application, a system for controlling flatness of sheets of media in a printing device comprising: a first transport baffle and a second transport baffle generally spaced apart to permit a sheet of media to pass; a plenum located adjacent to the first transport baffle; a blower to generate a flow of air to the plenum; and a sensor located adjacent to the second transport baffles and configured to measure a property of the sheet of media, wherein the plenum is configured to enable the air flow to urge the sheet of media toward the sensor during use.

According to another aspect of the application, a method for controlling flatness of sheets of media in a printing device comprising: providing a first transport baffle and a second transport baffle generally spaced apart to permit a sheet of media to pass; generating a flow of air to the first transport baffle, wherein air flow urges the sheet of media toward a sensor mounted in the second transport baffle; and measuring a property of the sheet of media using the sensor.

Other objects, features, and advantages of one or more embodiments of the present invention will seem apparent from the following detailed description, and accompanying drawings, and the appended claims.

BRIEF DESCRIPTION OF THE DRAWINGS

Embodiments of the present invention will now be disclosed, by way of example only, with reference to the accompanying schematic drawings in which corresponding reference symbols indicate corresponding parts, in which:

FIGS. 8A-8B show a top perspective of the upper transport baffle including the vent holes, in accordance with embodiments of the application, in which FIG. 8A shows vent holes that are staggered between air supply holes in the lower transport baffle; and FIG. 8B shows vent holes that are located directly above the supply holes in the lower transport baffle;

FIG. 13 shows a plot of distance from the sensor read plane for five 120 gsm sheets of paper with the dual plenum air system with the blower turned on.

DETAILED DESCRIPTION

This application proposes a methodology for a controlling substrate flatness using the flow of air to control paper flatness. This application relates to subject matter similar to that disclosed in co-pending U.S. patent application Ser. No. 12/246,113, filed Oct. 6, 2008, herein incorporated by reference in its entirety.

Figure 1:
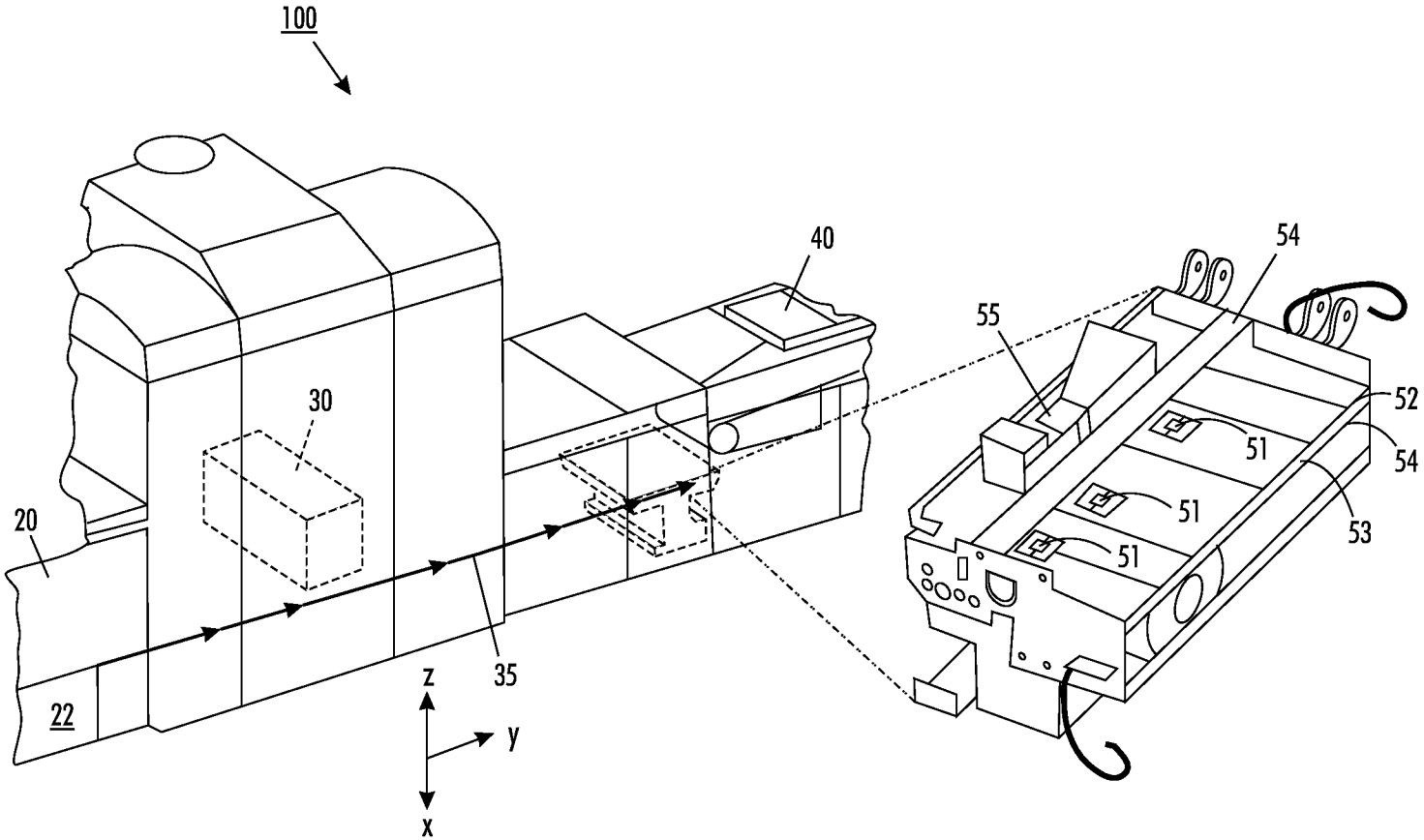
FIG. 1 shows an exemplary printing system, according to an embodiment of the application.

FIG. 1 shows an exemplary printing system 100, in accordance with an embodiment of the application. The printing system 100 generally includes a media handler 20, a print engine 30, and output finisher 40.

The print engine 30 may operate at a constant speed. The media handler 20 delivers a substrate, for example, a sheet of media from a hopper 22, to the print engine 30 at a specified time window for printing.

Generally, the substrate will be a sheet of paper. For example, the sheet of media may be a standard 8½×11 inch letter paper, A4 paper, or 8½×14 inch legal paper. However, it will be appreciated that other sizes and substrate media types may similarly be used, such as, bond paper, parchment, cloth, cardboard, plastic, transparencies, film, foil, or other print media substrates.

The print engine 30 may be a color xerographic printing system. In one implementation, the printing system 100 may be a Xerox Igen3® digital printing press. However, it will be appreciated that the print engine may be readily adapted for other kinds of printing technology, such as, for example, ink-jet (bubble jet), laser, offset, solid-ink, dye sublimation, etc.

After the substrate has been printed by the print engine 30, the printed substrate proceeds along an output media path 35 toward the output destination/finisher 40. The output destination/finisher 40 may include one of a plurality of output destinations, or output trays. In one embodiment, one or more of the output trays may be used as a purge tray. The output destination/finisher 40 may also perform final collating of the pages of the document. As is known in the art, the finisher can include any post-printing accessory device such as a sorter, mailbox, inserter, interposer, folder, stapler, stacker, hole puncher, collater, stitcher, binder, envelope stuffer, postage machine, or the like.

Located between the print engine 30 and the output finisher 40 there may be a Velocity Changing Transport (VCT) unit 50. The VCT 50 is a paper transport with at least one nip/idler 51 set to move the paper through the machine.

The VCT 50 generally includes an upper transport baffle 52 and lower transport baffle 54 spaced parallel defining a space 53 to permit a sheet of paper to pass. A sensor 55 may be mounted on the upper transport baffle 52 (or lower transport baffle 54). A slot, aperture, or hole which may be referred to as a "sensor window" (not shown) may be provided in the upper transport baffle (or lower baffle) to permit measurement of the substrate as it passes the sensor 55.

As the paper passes through the VCT 50 it may be accelerated. For example, the nip 51 may accelerate the paper from "process speed" (i.e., the speed that the paper is traveling when the image is transferred to the paper by the print engine) to two times (2×) process speed which is the speed a paper stacking mechanism (not shown) located in the output/finisher 40. In some implementations, the VCT 50 may also be located in the output module of the print engine 30 (for example, where a large print engine is broken into two modules due to the size). Other locations for the VCT 50 are also possible.

In one implementation, the sensor 55 may be an embedded or inline spectrophotometer (ILS) for making color spectral measurements of printed images on the substrate. For example, the ILS may be a point or strip spectrophotometer or a full width array (FWA) spectrophotometer, for example, as disclosed in U.S. Pat. Nos. 6,621,576, and 6,975,949, incorporated herein, in their entireties. It will be appreciated that in other implementations, the sensor 55 may be a calorimeter, a densitometer, a spectral camera, or other color sensing device. As the substrate passes through the VCT 50, the sensor measures a (top) surface of the sheet to detect a property of the sheet of media. Properties measured may include, for example, color, density, gloss, differential gloss, etc.

The substrate includes a length and a width oriented in an x-y plane. The x-direction and the y-direction may be also be referred to as the "process" and the "cross-process" directions, respectively. However, the height of the sheet of paper (as measured from the sensor 55) may vary in the Z-direction as it passes the sensor 55. Thus, a sensor "read plane" may be defined as a position to make an ideal sensor reading of the substrate. In some implementations, this may be the focal point of the sensor and/or the lower surface of the upper transport baffles. The read plane establishes a "zero location" (or origin point) for measuring a distance in the Z-direction from the read plane to surface of the substrate being measured. Other configurations and geometries are also possible.

In order to make accurate color density measurements with an inline spectrophotometer (ILS), the paper flatness may be controlled such that the distance (in the Z-direction) from the read plane to the surface of the substrate being measured is generally maintained to a desired specification, such as between −0.15 mm and +0.35 mm.

Experiments of the inventors have shown that the distance from the read plane typically varies from approximately 0.3 mm to 2.2 mm for points across the surface of the sheet of paper, with the greatest distance being generally at the leading and trailing edges. As such, accurate measurements using the ILS may be compromised and/or unobtainable.

Figure 2:
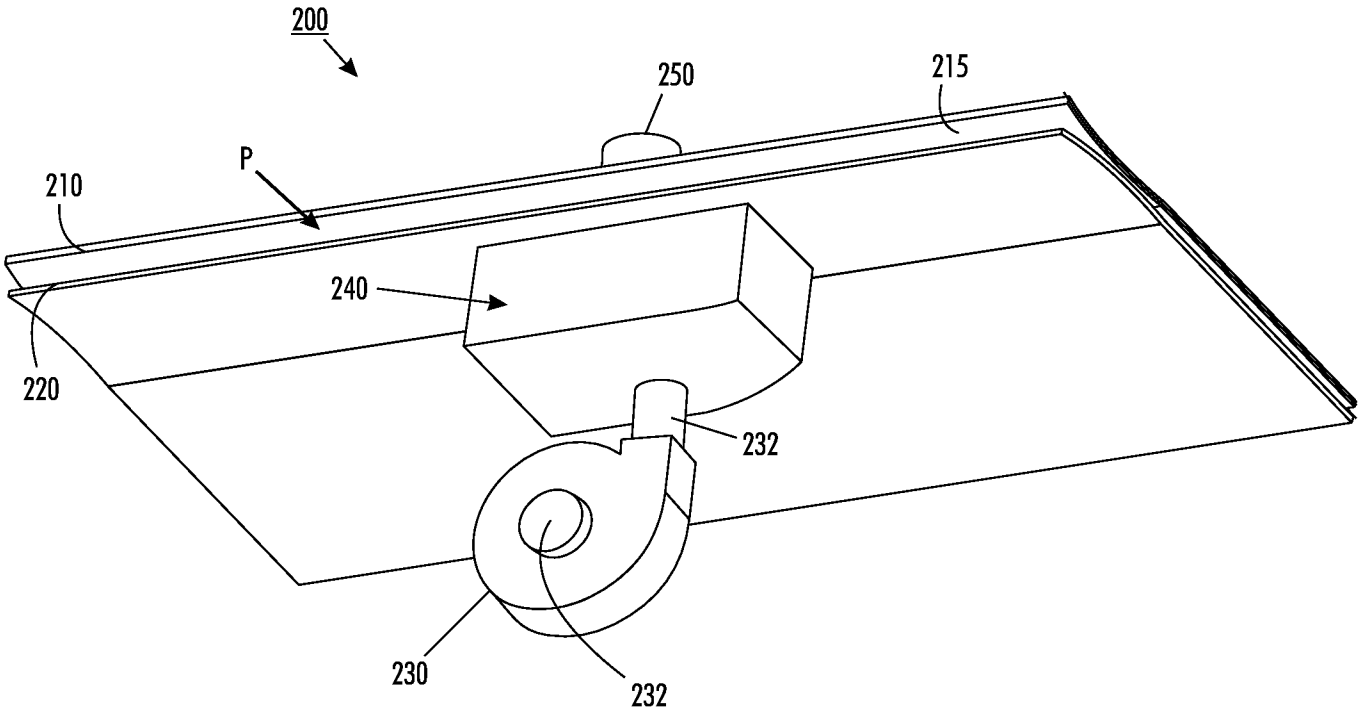
FIG. 2 shows a bottom perspective view of a single plenum air system, in accordance with an embodiment of the application.

FIG. 2 shows a bottom perspective view of a single plenum air system 200, in accordance with an embodiment of the application. The single plenum air system 200 controls substrate flatness to enable more accurate sensor measurements.

The single plenum air system 200 may generally include an upper transport baffle 210 and lower transport baffle 220 spaced parallel to each other, forming a space 215 to allow a substrate to pass therebetween, generally in a process direction P.

Air flows into a blower 230 from a blower inlet 232 The blower 230 forces air via a connecting hose 236 into the connecting plenum 240 located above the blower 230. In one implementation, the blower 230 may be an electric fan motor which operates at approximately 20 volts generating a rotation of about 9,000 RPM. The blower 230 may be controlled, for example, by a suitable controller, to provide a specified air flow to the plenum 240. The plenum 240 allows the air to flow through the slots/jets in an uniform manner. This provides an upward force to the paper towards the read plane.

Figure 3:
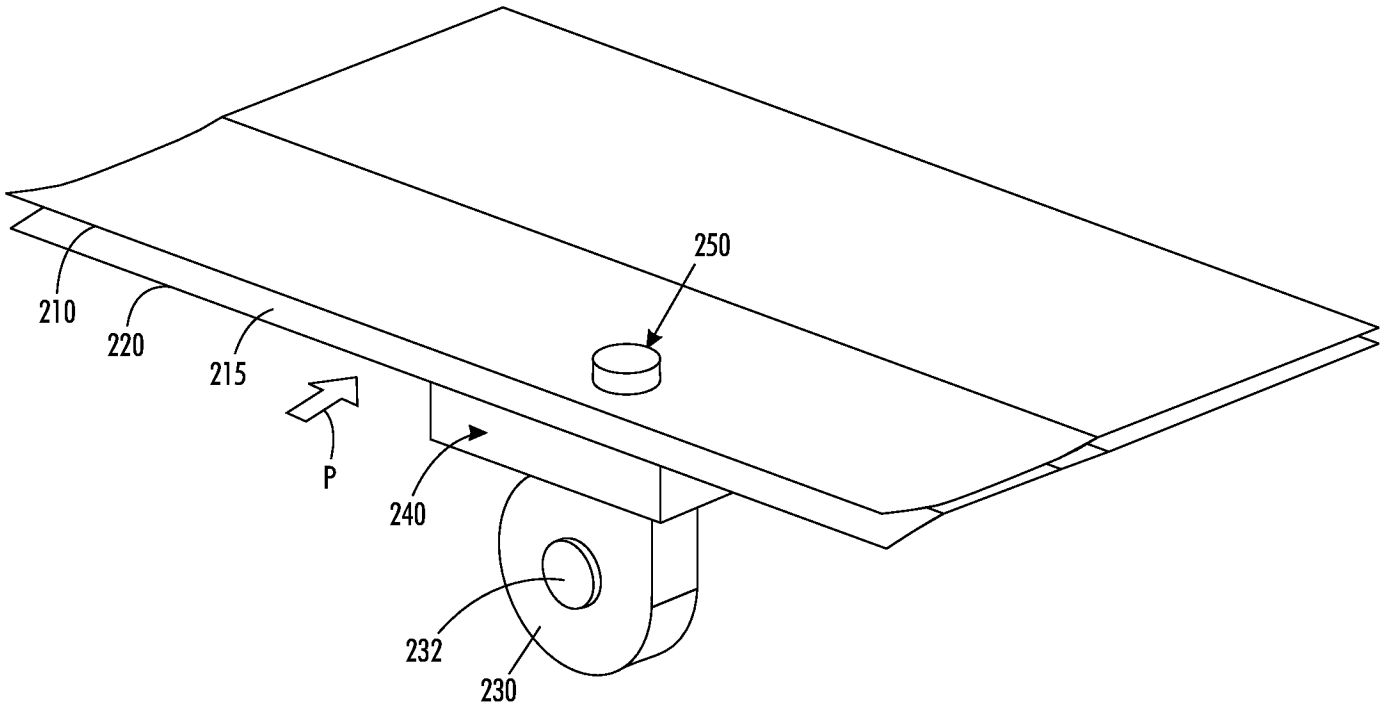
FIG. 3 shows a top perspective view of the a single plenum air system shown in FIG. 2.

FIG. 3 shows a top perspective view of the single plenum air system 200 shown in FIG. 2. A sensor 250 may be mounted on the upper transport baffle for measuring a property of a substrate, as discussed above. The sensor 250 is preferably aligned with the plenum 240 in the x- and y-directions.

Figure 4:
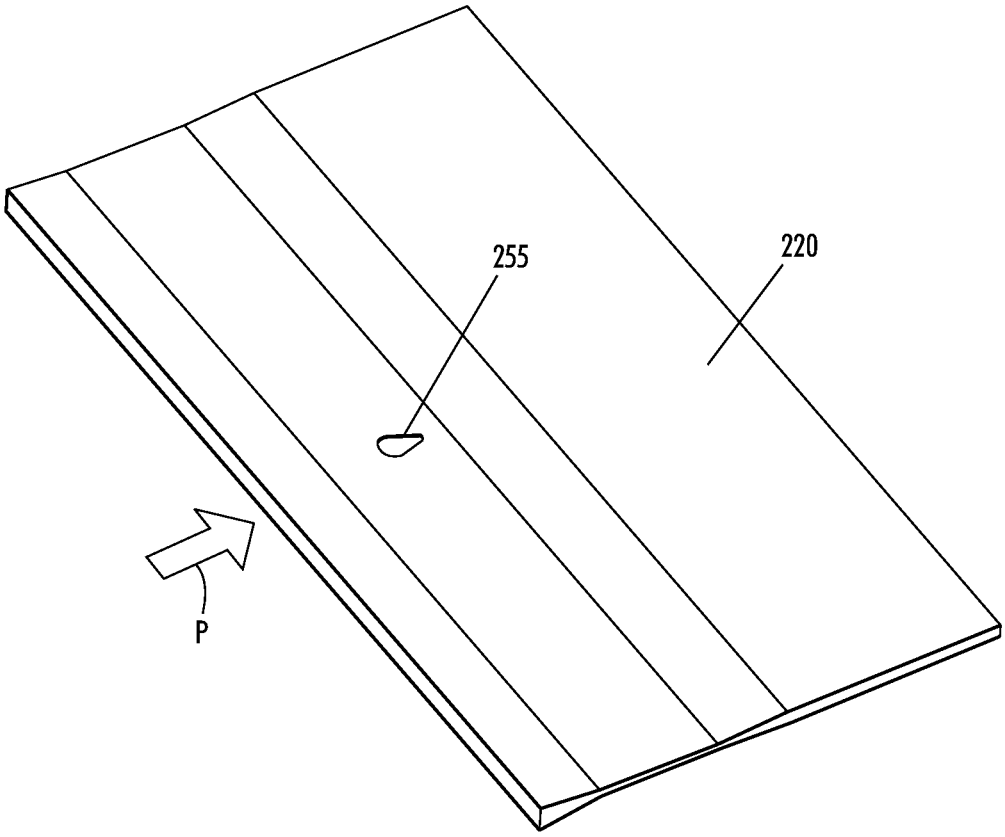
FIG. 4 shows a top perspective view of the upper transport baffle shown in FIG. 2.

FIG. 4 shows a top perspective view of the upper transport baffle 210 shown in FIG. 2. A slot, aperture, or hole which may be referred to as a "sensor window" 255, may be provided in the upper transport baffle (or lower baffle) to permit sensor measurement of a substrate as it passes the sensor 250. In some implementations, the sensor window 255 may include an optically transparent member, such as glass or film (not shown) to protect the sensor 250.

A sensor "read plane" may be defined as a position to make a sensor readings of the substrate. In some implementations, this may be the focal point of the sensor 250 or the lower surface of the upper transport baffles. The read plane establishes a "zero location" (or origin point) for measuring a distance in the Z-direction to surface of the substrate being measured.

Figure 5:
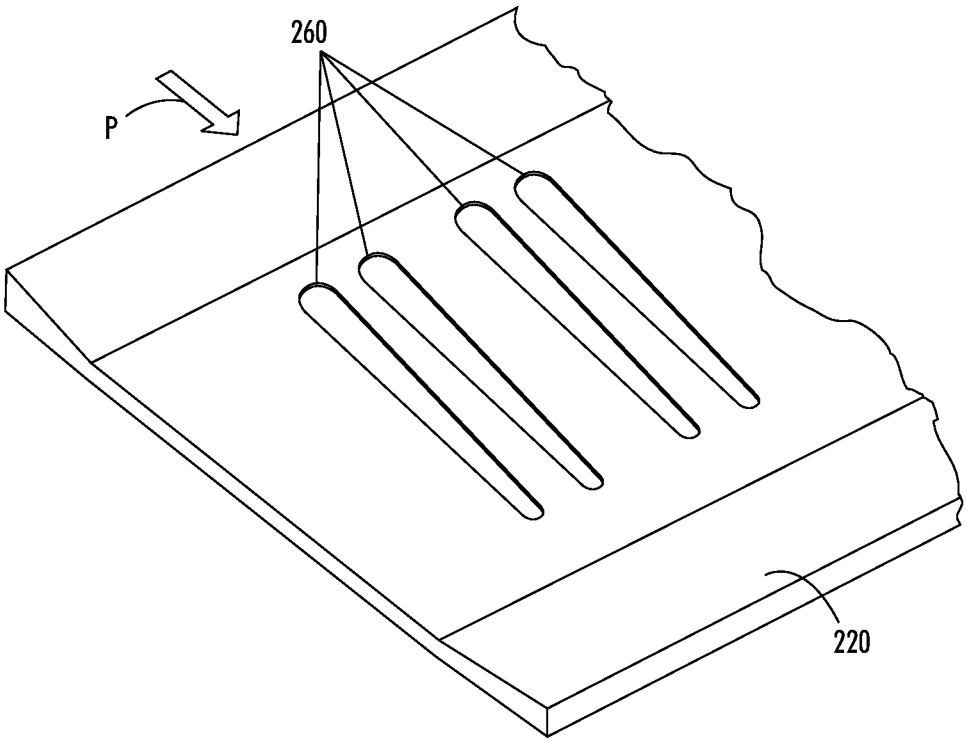
FIG. 5 shows a top perspective view of the lower transport baffle shown in FIG. 2.

FIG. 5 shows a top perspective view of the lower transport baffle 220 shown in FIG. 2.

Air from the plenum 240 flows through a series of slots of air supply holes 260 provided in the lower transport baffle 220 that urge the substrate up against the read plane. These air supply holes 260 may be circular, oblong, slot-shaped, elongated, etc., although teardrop-shaped may be preferred to minimize and/or prevent paper jams under the sensor. In one implementation, the air supply holes 260 may be spaced apart, for example, in the cross-process direction below the sensor 250.

In one implementation, the air supply holes 260 may be each have an effective width of about 5 mm and an effective length of about 9 mm, and be equally spaced approximately 24 mm apart.

While the supply holes 260 are shown in FIG. 5 as having the same generally shape and size, it will be appreciated that the supply holes 260 may have different shapes and sizes corresponding to different locations with respect to the sensor and/or the substrate, for example, to optimize air flow.

Deflection of the paper towards the read plane may be a function of the flow rate and/or the total pressure on the back of the paper. The resulting distance from the read plane to the sheet may depend of the characteristics of the sheet of media (e.g., area, weight, coefficient of friction, velocity, etc), the velocity of the air, the total pressure of the air on the back side of the paper. In turn, the velocity and pressure on the paper surface depends on the total flow of the system and the geometry of the slots.

Figure 6:
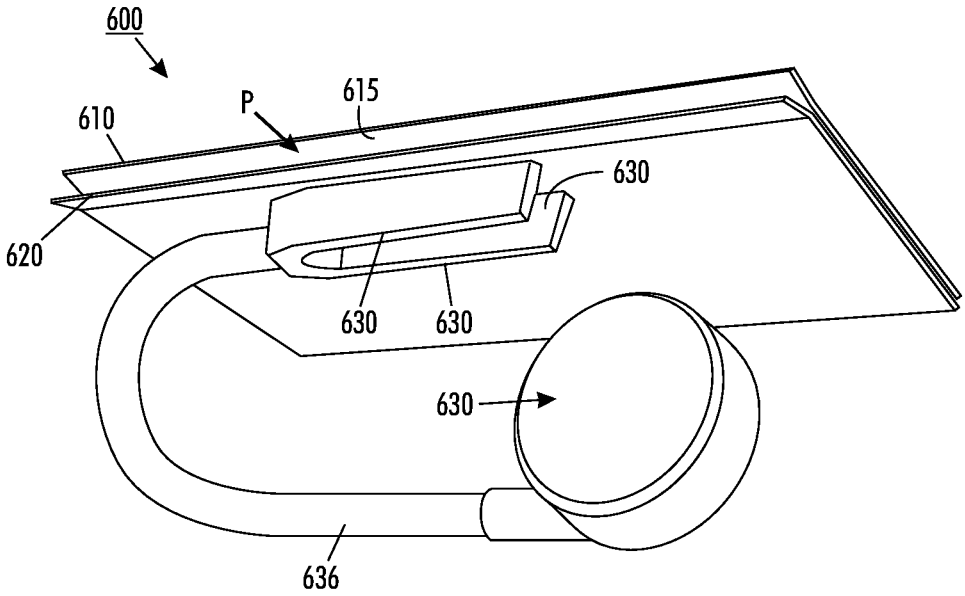
FIG. 6 shows a bottom perspective view of a dual plenum air system, in accordance with an embodiment of application.

FIG. 6 shows a bottom perspective view of a dual plenum air system 600, in accordance with an embodiment of application. The dual plenum air system 600 controls substrate flatness to enable more accurate sensor measurements.

The dual plenum air system 600 may include an upper transport baffle 610 and a lower transport baffle 620, forming a space 615 to allow a substrate to pass there between.

Air flows from a blower 630 through a connecting hose 636 into the dual plenum 640 provided below the lower transport baffle 620. The dual plenum 640 splits the air flow into two parallel sub-flow channels or paths 642, 644, with the first sub-flow path 642 located before and the second sub-flow path 644 after a sensor window. In other implementations, the dual plenum 640 may include additional channels (i.e., three, four, etc.) for splitting the air flow from the blower 630 into additional sub-flow paths.

Figure 7:
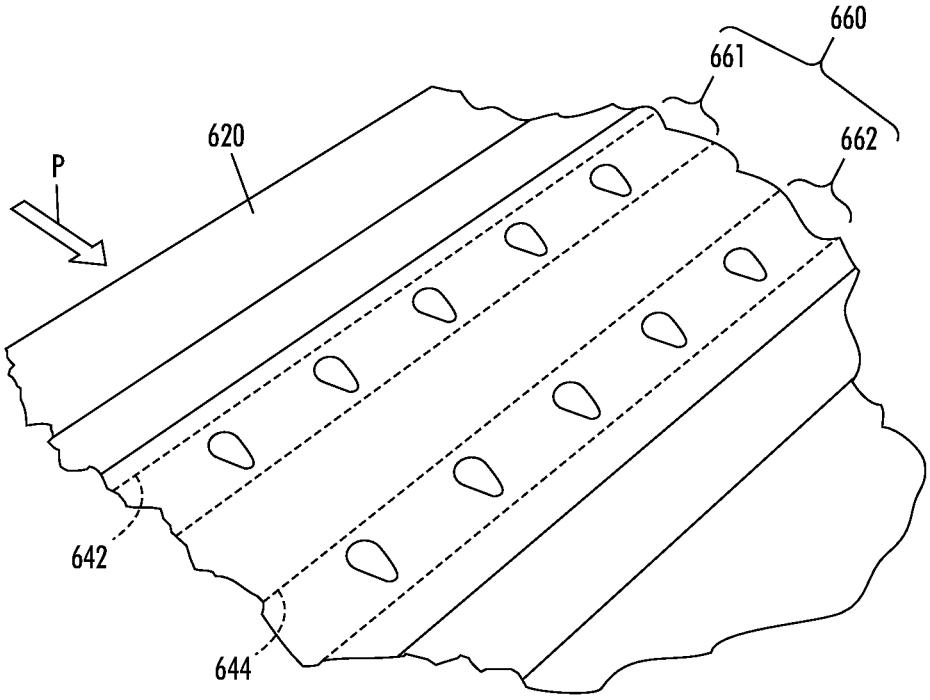
FIG. 7 shows a top perspective view of the lower transport baffle shown in FIG. 6.

FIG. 7 shows a top perspective view of the lower transport baffle 610 shown in FIG. 6. Air is passed from the dual plenum 640 through a series of air supply holes 660 located in the lower transport baffle 620 that urge the paper up against the read plane. These air supply holes 660 may be circular, oblong, slot-shaped, elongated, etc., although teardrop-shaped may be preferred to minimize and/or prevent paper jams under the sensor. In one implementation, the supply holes may have an major (nominal) diameter of approximately 5 mm.

The air supply holes 660 may generally coincide with the two parallel sub-flow paths 642, 644 of the dual plenum (shown in dotted line) located before and after the sensor in the cross-process direction thus, forming series of leading edge (LE) air supply holes 661 and a plurality of trailing edge (TE) air supply holes. In one implementation, the leading edge air supply holes 661 and the trailing edge air supply holes 662 may be spaced apart approximately 25 mm.

The leading edge air supply holes 661 may be equally spaced apart from each other. In one implementation, the leading edge air supply holes 661 may be spaced apart approximately 24 mm apart from each other. Similarly, the holes forming the trailing edge holes 662 may be equally spaced apart in the same manner, generally corresponding to the leading edge air supply holes.

In some implementations, the upper transport baffle 610 may be similarly configured as the upper transport baffles 220 (FIG. 4).

Figure 8A:
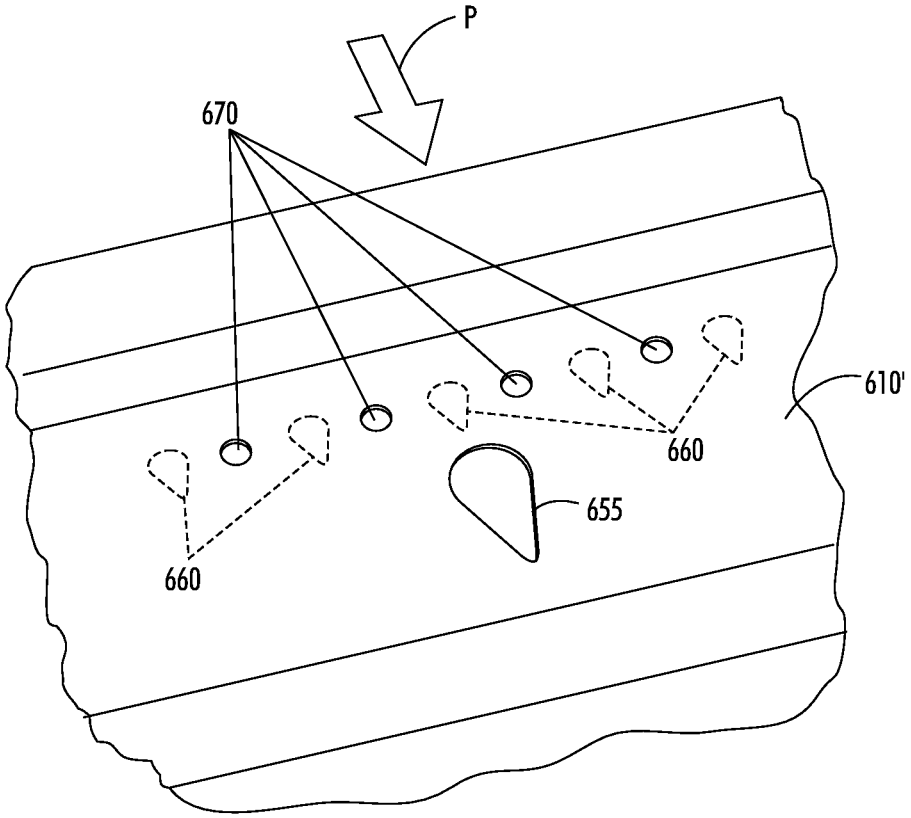
Figure 8B:
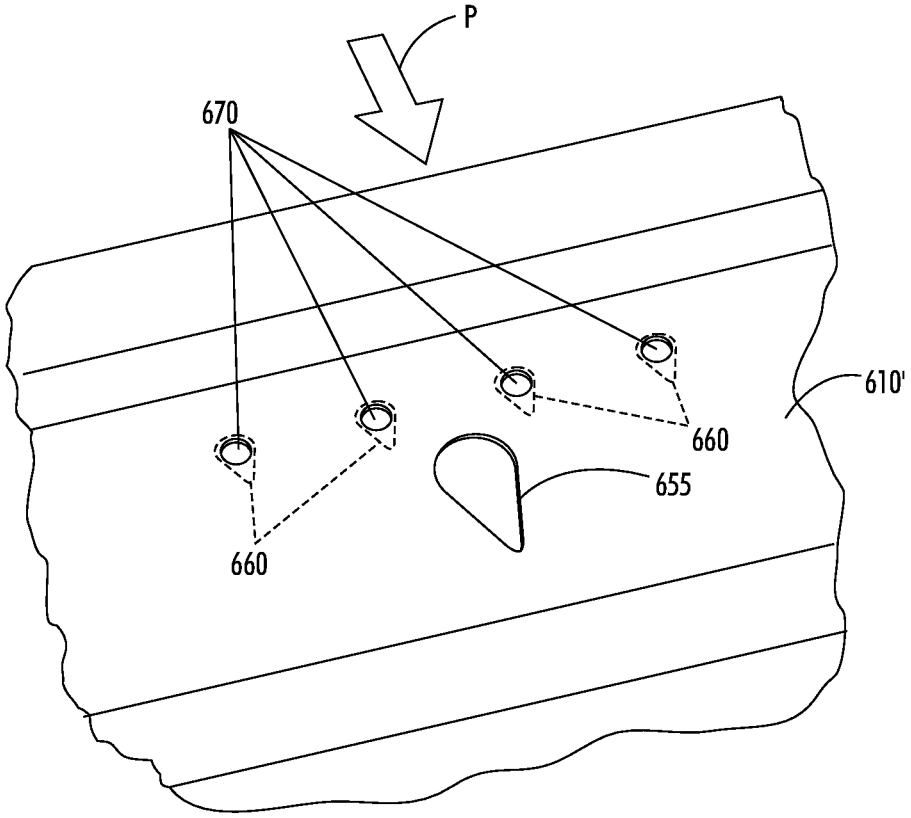

FIGS. 8A-8B show a top perspective view of the upper transport baffle 610 shown in FIG. 6, in accordance with embodiments of the application. While the drawings show use with the dual plenum air system 600 (FIG. 6), it will be appreciated that these embodiments may also be used with the single plenum air system 200 (FIG. 2).

According to one aspect of the application, in addition to the supply holes 660 provided in the lower transport baffle 620, a series of vent holes 670 may be provided in the upper transport baffle 610' before the sensor window 655. These vent holes 670 help to reduce air velocity at the LE air supply holes 661.

In one implementation, the vent holes 670 may be circular, each having a diameter of approximately 3.65 mm. Although, it will be appreciated that vent holes 670 having other shapes and sizes are also possible. The locations of air supply holes 660 (FIG. 7) in the lower transport baffle are shown in broken-line form.

In FIG. 8A, the vent holes 670 in the upper transport baffle 610' may be staggered between the air supply holes 660 in the lower transport baffle (for example, as shown in FIG. 7). This configuration may provide increased control of the LE of the substrate.

In FIG. 8B, vent holes 670 in the upper transport baffle 610" may be located directly above and generally coincide with the air supply holes 660 in the lower transport baffle. The latter configuration may provide increased control of both the LE and TE of the substrate.

While not shown in the figures, alternatively or additionally, it will be appreciated that similar vent holes may be provided that correspond with the leading edge vent holes 662 shown in FIG. 7.

The inventors have found that regardless of the location or shape of the vent holes, the provision of the vent holes 670 on the upper transport baffle 610 was shown to provided better control the LE of the sheet. As a result, the sheet flatness control in the center part of the sheet was not compromised.

Figure 9:
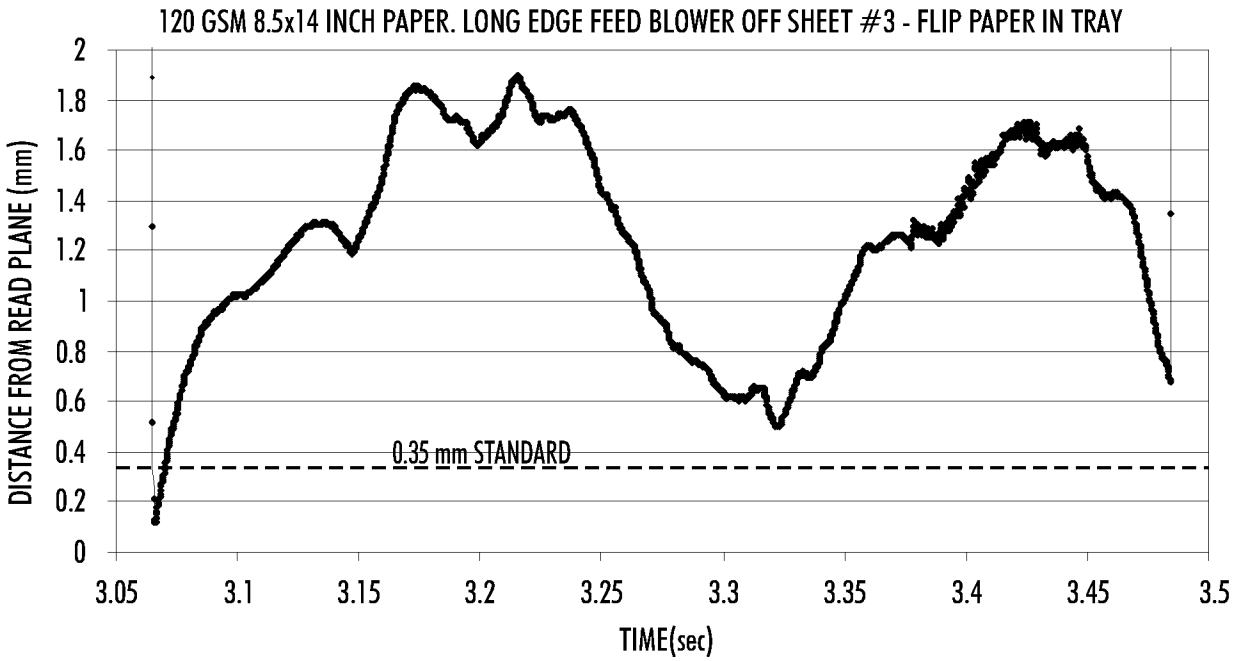
FIG. 9 shows a plot of distance from the sensor read plane for a single 120 gsm sheet of paper with the dual plenum air system, turned off.

FIG. 9 shows a plot of distance from the sensor read plane for a single 120 grams/sq. meter (gsm) sheet of paper with the single plenum air system 600 (FIG. 6), turned off. It is apparent that the distance from the read plane exceeds the 0.35 mm specification for essentially the entire length of the sheet as it passed the sensor. Further experiments showed that without the single plenum air system 200, or the dual plenum air system 600, turned on, that each of the paper weights tested ranging from 67 gsm to 350 gsm all failed to meet the 0.35 mm specification.

Figure 10:
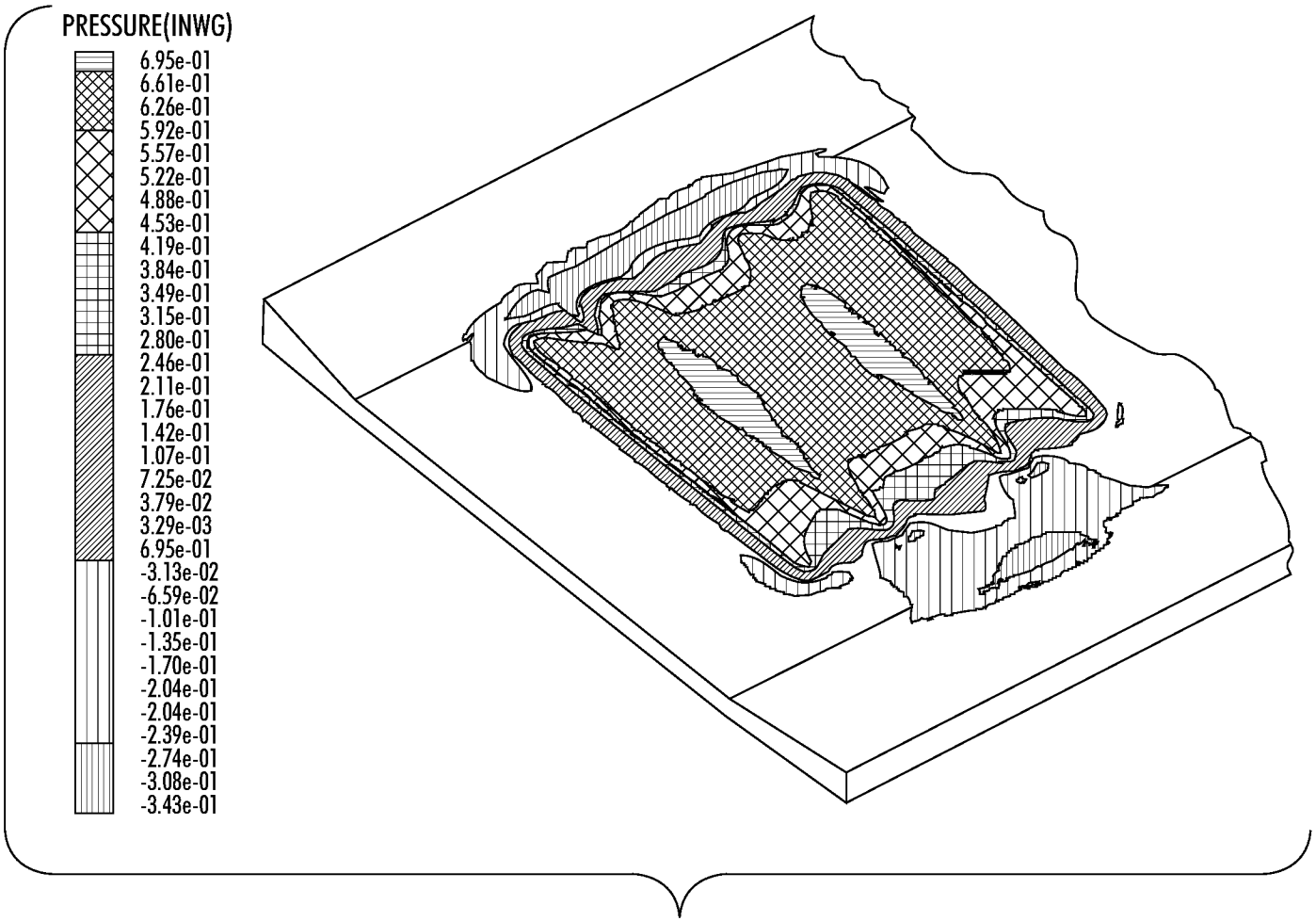
FIG. 10 shows a plot of the pressure distribution on the back side of a sheet of the paper, for the single plenum air system.

FIG. 10 shows a plot of the pressure distribution on the back side of a sheet of paper, with the single plenum air system 200 (FIG. 2), turned on. A total flow rate of about 9.37 cubic feet per minute (CFM) was realized at the exit of the air supply holes producing an average static pressure at the exit of the supply holes of 0.68 inch water gauge (inwg). With this configuration, flow levels were found to be acceptable for measuring sheets of paper less than 120 gsm.

Figure 11:
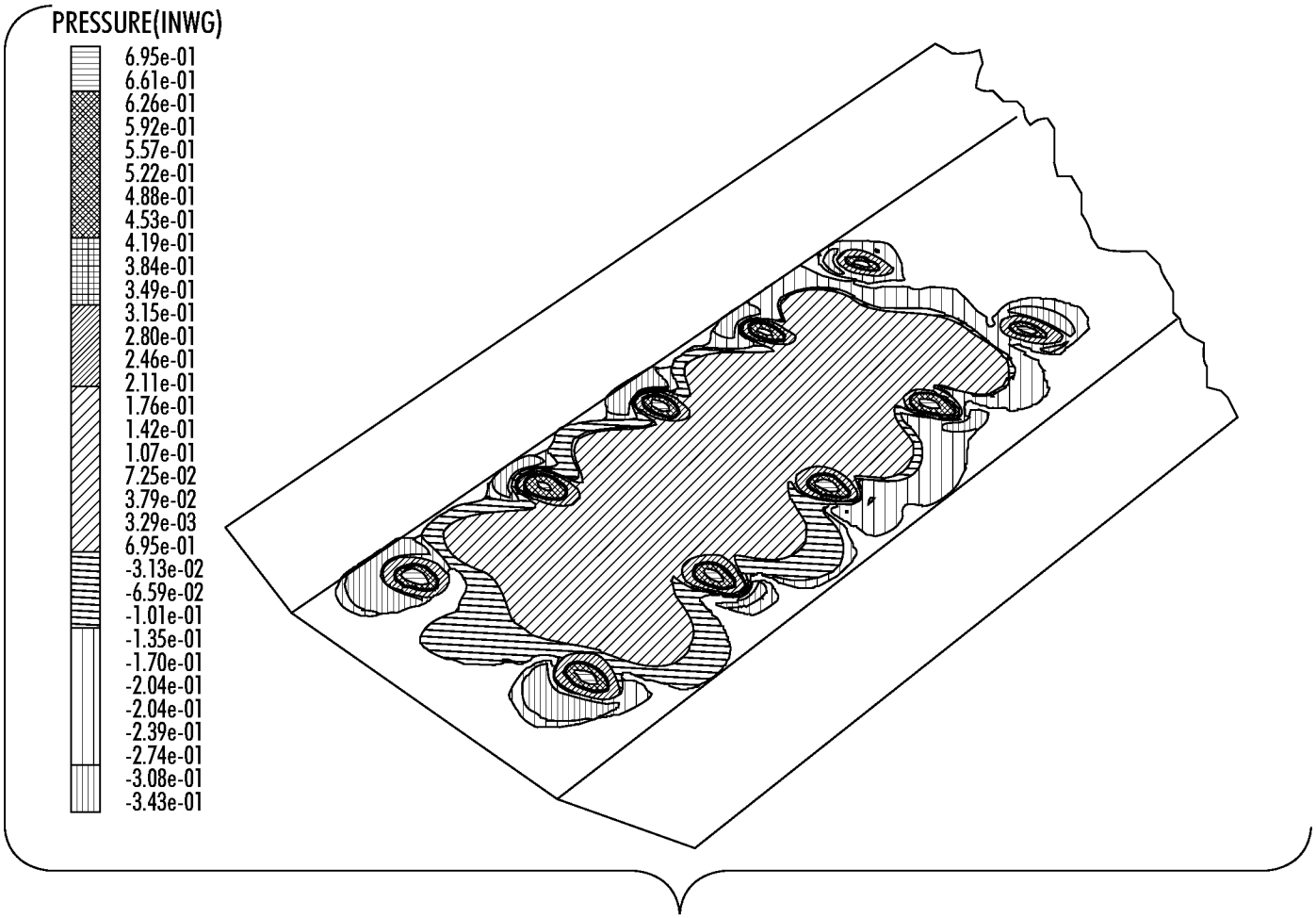
FIG. 11 shows a plot of the pressure distribution on the back side of a sheet of paper for the dual plenum air system.

FIG. 11 shows a plot of the pressure distribution on the back side of a sheet of paper for the dual plenum air system 600 (FIG. 6), turned on. A total flow rate of 17.3 CFM was realized at the exit of the supply holes producing an average static pressure at the exit of the supply holes is 3.93 inwg. This configuration was an improvement in static pressure over the single plenum air system 200 (FIG. 2).

Figure 12:
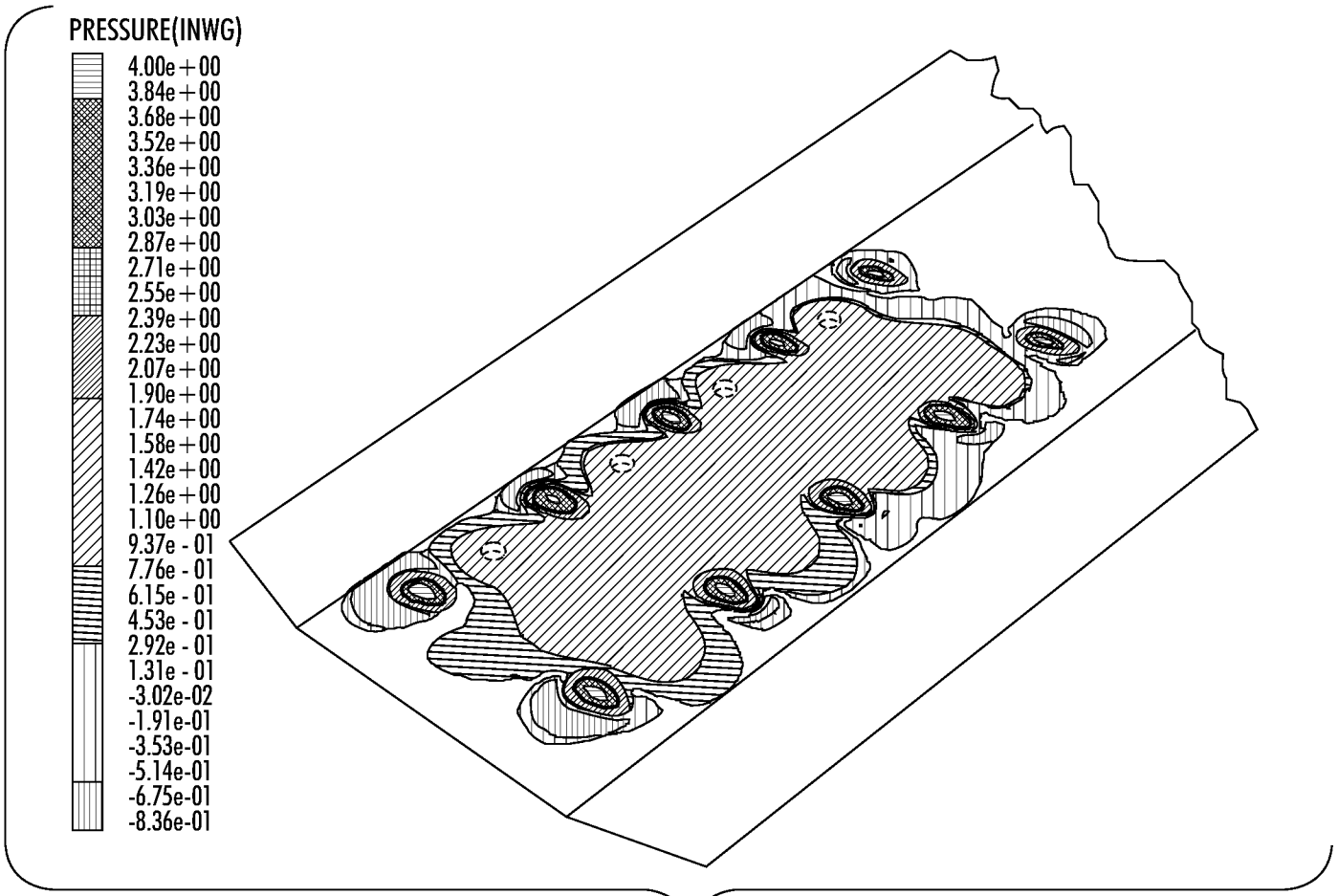
FIG. 12 shows a plot of the pressure distribution on the back side of a sheet of paper for the dual plenum air system where the upper transport baffle includes vent holes.

FIG. 12 shows a plot of the pressure distribution on the back side of a sheet of paper for the dual plenum air system 600 (FIG. 6) turned on, where the upper transport baffle includes vent holes 670 (FIG. 8A). The location of the vent holes is shown in dotted line form.

A total flow rate of 17.1 CFM was realized at the exit of the supply holes producing an average static pressure at the exit of the supply holes is 4.0 inwg. Adding the vent holes reduced the air velocity approaching the paper LE from 14 m/s to 10 m/s. Further experiments showed that the addition of the vent holes reduced the LE and TE distances for a sheet of paper from the read plane by as much as 15%. Although, this result was less pronounced for paper weights above 120 gsm.

Figure 13:
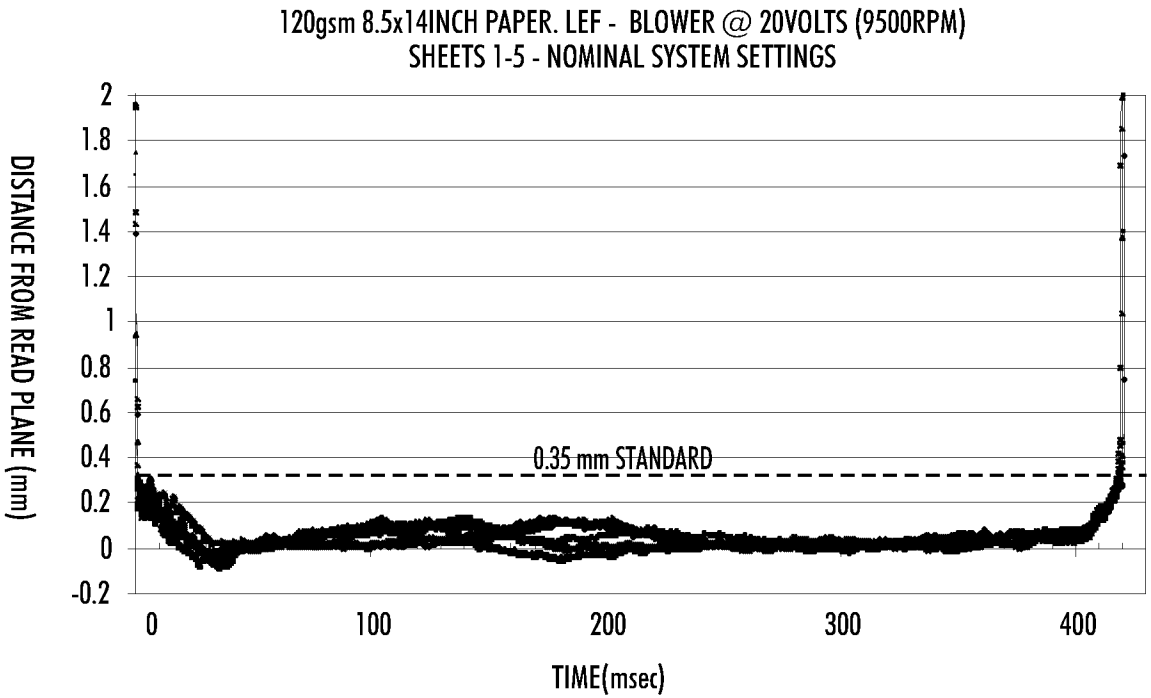

FIG. 13 shows a plot of distance from the sensor read plane for five 120 gsm sheets of paper with the dual plenum air system 600 (FIG. 6) with the blower turned on. It is apparent that the distance from the read plane is within 0.35 mm specification for the entire run. Equally important is that the leading and trail edge distances from the read plane are also within specification.

Further experiments showed, though, that this result may not be consistent for all sheets and all paper weights. For example, the leading and trailing edges of some sheets, especially for heavier sheets of paper, may exceed the 0.35 mm specification. However, since ILS color spectral measurements are typically not made within 20 mm of the leading edge or trailing edge of the sheet this is not believed to pose a problem.

Methods of using the various embodiments disclosed in the application are also provided. Although, the embodiments disclosed herein show the sensor located on the upper transport baffle and the air flow coming from the lower transport baffle, it will be appreciated that the configuration can be reversed (i.e., the sensor on the bottom and air flow coming from the top). Other configurations are also possible, such as for side mounted sensors for monitoring vertically oriented sheets of media. Moreover, while the embodiments disclosed herein show a Velocity Changing Transport (VCT) 50 (FIG. 1), it will be appreciated that the embodiments disclosed herein may be used with any system, in which substrate flatness may be a concern.

While this invention has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

What is claimed is:

1. A system for controlling flatness of sheets of media in a printing device comprising:

a first transport baffle and a second transport baffle generally spaced apart to permit a sheet of media to pass;

a plenum located adjacent to the first transport baffle;

a blower to generate a flow of air to the plenum;

a sensor located adjacent to the second transport baffle and configured to measure a property of the sheet of media, wherein the plenum is configured to enable the air flow to urge the sheet of media toward the sensor during use; and a nip located adjacent to one or both of the first and second transport baffles which is configured to increase the velocity of the sheet of media while the sheet of media is measured by the sensor, wherein the velocity of the sheet of media, while the sheet of media is measured by the sensor, is increased relative to a process speed applied to the sheet of media when an image is transferred to the sheet of media, and wherein the velocity of the sheet of media, while the sheet of media is measured by the sensor, is increased to two times the process speed.

2. The system according to claim 1, wherein the first transport baffle comprises a plurality of air supply holes.

3. The system according to claim 2, wherein the second transport baffle includes a plurality of vent holes.

4. The system according to claim 3, wherein the locations of the plurality of vent holes in the second transport baffle are staggered relative to the locations of the plurality of holes in the first transport baffle.

5. The system according to claim 3, wherein the locations of the plurality of vent holes in the second transport baffle substantially coincide to the locations of the plurality of holes in the first transport baffle.

6. The system according to claim 2, wherein the plurality of air supply holes is teardrop shaped.

7. The system according to claim 1, wherein the plenum comprises a dual plenum that divides the air flow into two parallel air sub-flows located before and after the sensor.

8. The system according to claim 7, wherein the first transport baffle comprises a plurality of air supply holes, corresponding to the two parallel air sub-flows.

9. The system according to claim 1, wherein, while the sheet of media is measured by the sensor, the sheet media is positioned at a predetermined distance from a sensor read plane.

10. The system according to claim 9, wherein the predetermined distance is within a range between −0.15 mm and +0.35 mm.

11. The system according to claim 1, wherein the sensor is one of: a spectrophotometer, a colorimeter, a densitometer, or a spectral camera.

12. The system according to claim 1, wherein the second transport baffle includes a sensor window that is constructed and arranged to permit measurement of a property of the sheet of media while the sheet of media is passing the sensor.

13. The system according to claim 1, wherein the velocity of the sheet of media, while the sheet of media is measured by the sensor, is increased to the speed of a post-printing finishing device.

14. The system according to claim 1, wherein, after scanning of the sheet of media by the sensor, the sheet media is output at the increased velocity to an output finishing device.

15. A method for controlling flatness of sheets of media in a printing device comprising a first transport baffle and a second transport baffle generally spaced apart to permit a sheet of media to pass, the method comprising;

generating a flow of air to the first transport baffle, wherein air flow urges the sheet of media toward a sensor mounted in the second transport baffle;

measuring a property of the sheet of media using the sensor; and increasing the velocity of the sheet of media while the sheet of media is measured by the sensor, wherein the velocity of the sheet of media, while the sheet of media is measured by, the sensor, is increased relative to a process speed applied to the sheet of media when an image is transferred to the sheet of media, and wherein the velocity of the sheet of media, while the sheet of media is measured by the sensor, is increased to two times the process speed.

16. The method according to claim 15, wherein the first transport baffle comprises a plurality of air supply holes.

17. The method according to claim 16, wherein the second transport baffle includes a plurality of vent holes.

18. The method according to claim 17, wherein the locations of the plurality of vent holes in the second transport baffle are staggered relative to the locations of the plurality of holes in the first transport baffle.

19. The method according to claim 17, wherein the locations of the plurality of vent holes in the second transport baffle substantially coincide to the locations of the plurality of holes in the first transport baffle.

20. The method according to claim 16, wherein the plurality of air supply holes is teardrop shaped.

21. The method according to claim 15, wherein generating a flow of air comprising dividing the air flow into two parallel air sub-flows located before and after the sensor.

22. The method according to claim 21, wherein the first transport baffle comprises a plurality of air supply holes, corresponding to the two parallel air sub-lows.

23. The method according to claim 15, wherein the sensor is one of: a spectrophotometer, a colorimeter, a densitometer, or a spectral camera.

24. The method according to claim 15, wherein the second transport baffle includes a sensor window that is constructed and arranged to permit measurement of a property of the sheet of media while the sheet of media is passing the sensor.

* * * * *